US005104254A

United States Patent [19]

Durand

[11] Patent Number: 5,104,254

[45] Date of Patent: Apr. 14, 1992

[54] TRAFFIC DIVIDER WITL BALLAST FILL AND DRAINAGE CHANNEL

[75] Inventor: Robert E. Durand, Rambouillet, France

[73] Assignee: Materiels et Applications de Securite pour les Aeroports l'Industrie et les Routes, France

[21] Appl. No.: 548,009

[22] Filed: Jul. 5, 1990

[30] Foreign Application Priority Data

Jul 6. 1989 [FR] France ..... 89 09108

[51] Int. Cl.[5] ..... E01F 13/00; E01F 15/00

[52] U.S. Cl. ..... 404/6

[58] Field of Search ..... 404/6

[56] References Cited

U.S. PATENT DOCUMENTS

| | | | |
|---|---|---|---|
| 4,515,499 | 5/1985 | Furiate | 404/6 |
| 4,576,507 | 3/1986 | Terio | 404/6 |
| 4,681,302 | 7/1987 | Thompson | 404/6 X |
| 4,708,515 | 11/1987 | Davies | 404/6 |
| 4,772,155 | 9/1988 | Dinitz | 404/6 X |
| 4,854,767 | 8/1989 | Sasaki | 404/6 |
| 4,869,617 | 9/1989 | Chiodo | 404/6 |
| 4,925,333 | 5/1990 | Bishop | 404/6 |
| 4,946,306 | 8/1990 | Yodock | 404/6 |

*Primary Examiner*—Ramon S. Britts
*Assistant Examiner*—Nancy P. Connolly
*Attorney, Agent, or Firm*—Wolf, Greenfield & Sacks

[57] ABSTRACT

A track separator element for combining with other like elements to form a track separator for separating areas in which vehicle traffic flows from other areas. The track separator element is formed from a hollow body for accommodating ballasting fluid and has lateral flaps extending from its bottom base portion. The lateral flaps have deformations formed on their top surface for generating noise when a vehicle rides over them. An evacuation nozzle is connected to a hollow tube that allows the ballasting liquid to be easily emptied out of the element.

9 Claims, 4 Drawing Sheets

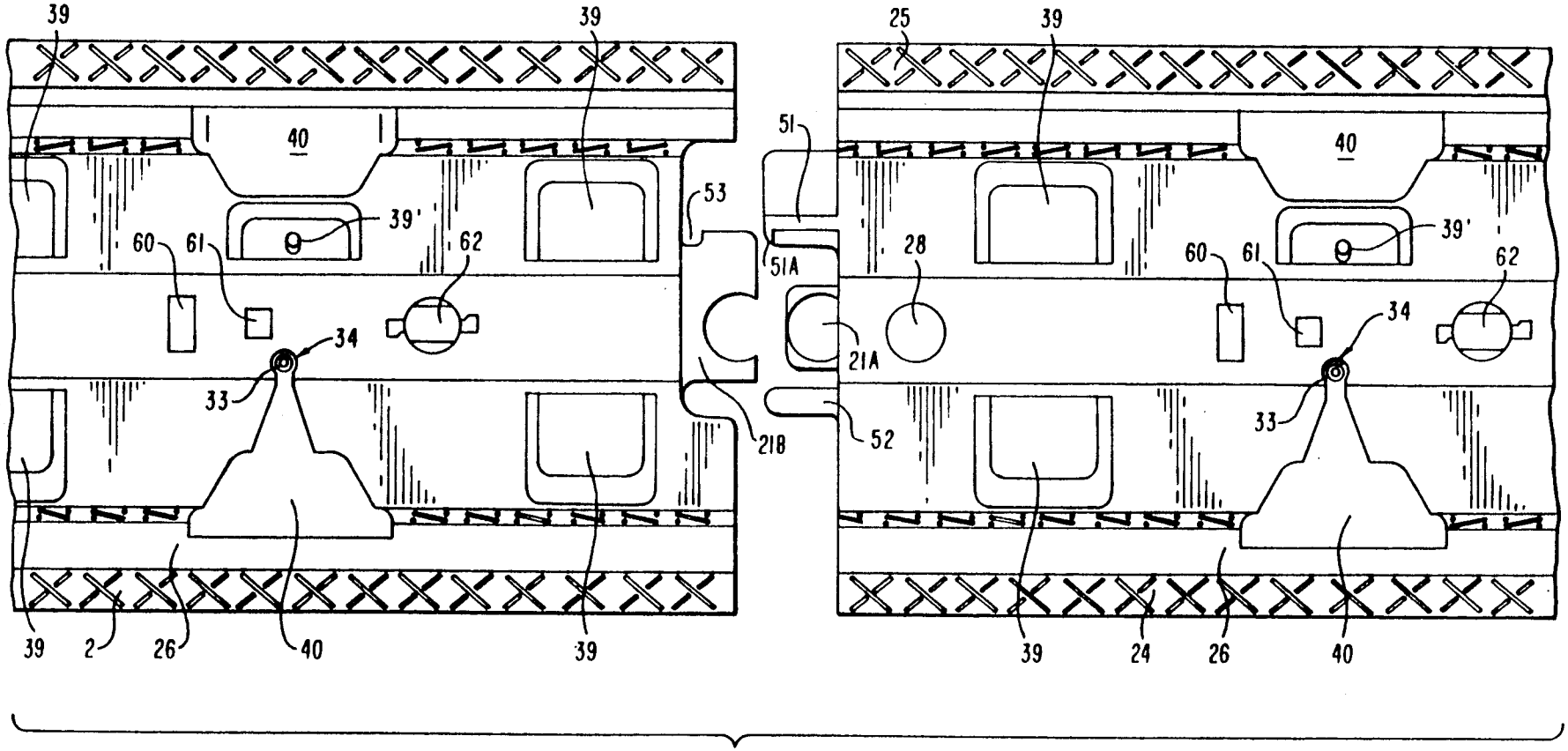
FIG. 4
(AMENDED)

TRAFFIC DIVIDER WITL BALLAST FILL AND DRAINAGE CHANNEL

The present invention relates to a track separator element provided at each end with assembly devices in order to be assembled with other elements of this type and to form a track separator, the element comprising a hollow body which can be filled with ballasting liquid and a base for supporting it on the ground.

Separator elements of this type are known according to different embodiments. These separator elements are to be asssembled in order to form track separators installed in a temporary manner for a more or less long period with if necessary one or several daily displacements of the elements all along the length of the separator, for example in order to alter the number of traffic lanes in one direction or in the other according to traffic at different times of the day.

Initially, these separators were composed of concrete blocks in trapezoid section and ending with an extension. These separators similar to the "New Jersey" type separators were replaced in many cases by separator elements made of plastics materials which could be filled and which facilitated the displacement problems on the sites where they were used or transport to the site or the place where they were stored.

However, all of these different separator elements have a relatively large width which obstructs the traffic and is necessary in order that these elements have sufficient stability in order to resist certain bias impact and to effectively separate the traffic lanes in a very safe manner.

The drawback with this relatively large width is the encroachment on the traffic lane. More precisely, in the majority of cases where these separators are used the tracks are not of a normal width and every reduction in width, by the encroachment of the separators, reduces accordingly the available width which increases the risk of impact with the vehicles and which requires the traffic to travel at very reduced speeds etc.

Furthermore, and despite the relatively significant weight of certain elements and the very sophisticated means of fastening and connecting the elements to each other, they move under the effect of an impact and often encroach in a significant and above all dangerous manner upon the adjacent track.

Finally, although the hollow elements which can be filled are easy to manipulate when they are empty it is not the same when they are full. In order to empty them it is necessary to unscrew a plug but after they have been screwed/unscrewed several times without particular precaution being taken the threads are damaged and the plugs can no longer be screwed or rendered sealed. It is for this reason that the elements are filled and emptied via their upper opening; however in order to do this they have to be tilted up.

The present invention aims to remedy these drawbacks and proposes to provide a track separator element, which can be filled, which is easy to install and empty so that it can be moved, of which the resistance to displacement in case of impact is improved without the elements having to be attached to the ground and if possible by reducing the width which obstructs the traffic with respect to that of the elements without complicating the production or installation thereof.

The invention also aims to provide a separator element which, whilst allowing the vehicle to go over onto its base, informs motorists that they are getting too close to the side of the separator and risk bumping into it and which prevents the element from being able to slide at the moment when the tire approaches the base or if it does slide that the stresses thus induced in the element can be absorbed effectively by the upstream element and the downstream element, and finally in order that if a wheel approaches the side of the element and rubs against it this element has no roughness which can abruptly increase this rubbing effect and cause a collision.

To that effect, the invention concerns a track separator element of the above type having the characteristics of the first claim.

In this way, as the base of the element is laterally provided, on each side, with a support band, when the wheel of a vehicle rolls on this band, the element is locked in place by the weight of the wheel and of the vehicle and cannot move. This is also true when the wheel only begins to roll onto the band although the weight of the wheel would not be sufficient at this moment to prevent the block from sliding. However as the element in question is connected by means of a non-extensible articulation to the upstream element and to the downstream element, this element cannot move back or deviate from course owing to this connection to the other elements.

The removal of an element is extremely simple because in order to empty it it is sufficient to remove the tube of its holding device and to let it fall to the ground. The water of the element is discharged by itself. This enables the removal procedures of elements of this type to be simplified considerably because it is not necessary to tilt up elements of this type filled with liquid; Moreover this tilting is difficult to do by hand because, on the one hand the element alone is heavy and can contain in the order of 300 liters of water an on the other hand the element must first be separated from the elements adjacent thereto. The latter necessitates means of connection between the elements which can be opened when the elements are still in place. It is often difficult to open them because if the elements were slightly displaced this displacement is expressed by considerable traction stresses exerted between the elements and these traction stresses in general block the assembling means: two problems then arise: elements which cannot be separated in order to empty them and as a result cannot be tilted up as at this moment they are too heavy. It is therefore necessary according to the prior art to begin to separate the last element from the line, to empty it then to pass to the following element and so on.

On the other hand, according to the invention, the order in which the elements are evacuated does not matter and it is even possible to remove the intermediary elements by leaving in place the other elements as once the elements (s) is (are) empty it is sufficient to remove them vertically, which is possible and easy as the elements are not heavy but only bulky. This process is further facilitated by handles situated at the ends of the elements.

As moreover, the elements are fitted with lateral protection and continuity devices, at the articulation, the roughness which can catch a vehicle too close to the element is a practically non-existent risk.

Finally, the manner in which the elements are emptied is very simple by disengaging the tubes; it is not necessary as already indicated to unscrew a plug, a lengthy process in itself and furthermore this unscrewing step frequently renders the elements unusable because after they have been screwed up several times, when the screws have been cross-threaded, screwing up and/or sealing are no longer possible.

Other characteristics of the invention are the object of claims 2 to 9.

The present invention will be described in a more detailed manner using the attached diagrams in which:

FIG 4 is a top view of two track separators and illustrates the connection between the male and female assembly devices.

Figure 1:
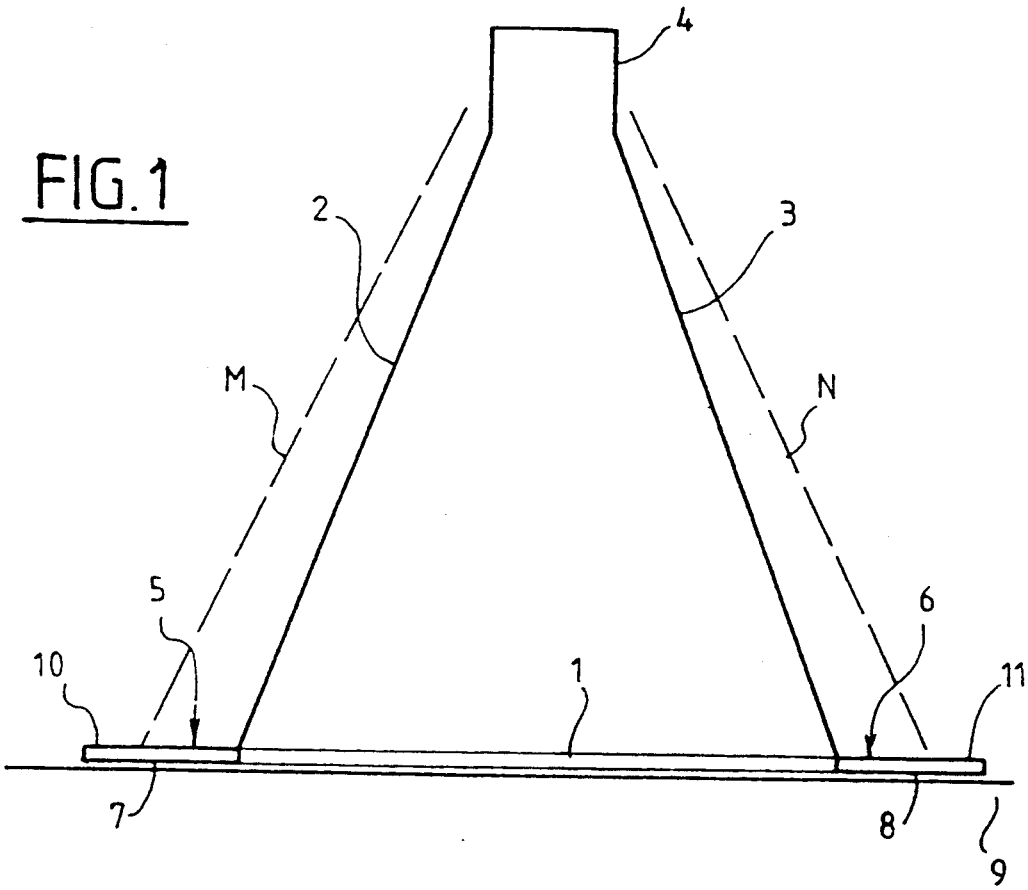
FIG. 1 is a principle diagram of a separator element according to the invention, showing in dashed lines the shape and seating on the ground of a known separator element.

According to FIG. 1, the track separator element which has length enabling it to be manipulated and depending on the material from which it is made (for example in the order of 1.2 m to 1.5 m) has a substantially triangular section with a base (1), inclined sides (2, 3), a top (4) and connection and/or articulation means at the ends of each element. The latter means can take on the most diverse of forms.

This separator element is provided with lateral bands (5, 6) which extend all along the length of the separator in a continuous or discontinuous manner by overlapping if necessary in order that the lateral bands of a separator cover those of the other in the direction in which the vehicles are travelling.

The lower surface (7, 8) of the lateral bands consists of means increasing the adherence of these surfaces on the ground (9). The upper surfaces (10, 11) of the lateral bands are provided with deformations such as striae, bosses and grooves, which generate a sound when a vehicle tire passes over these bands.

The width of the lateral bands (5, 6) is sufficient for a vehicle wheel to go over the band and press it sufficiently to the ground in order to block the separator element.

The adherence to the ground of the separator elements according to the ivention is increased by the means (7, 8) such as the rough parts, supple surfaces, ets. produced under lateral bands (5, 6).

When a wheel rolls onto one of the bands (5, 6), even if the vehicle or the wheel touches the separator element, they cannot push it back as the wheel is pressing on the band. In addition, the rolling of the wheel to the surface (10, 11) of the band (5, 6) produces a sound depending on the speed of the travel and the distribution of the deformations. This sound is picked up by drivers who know they are going over the lateral band and that they must correct the direction in which they are travelling.

The outline of a known separator element is represented in short dashes with the references M, N, showing the seating on the ground and the spatial requirement.

FIGS. 2 to 6 explain the means of the invention by a particularly advantageous embodiment.

The separator element (20), in the form of a prismatic, hollow chamber, which can be filled with a ballasting liquid (water) comprises at each end an assembly device 21A, 21B, (FIG. 4). At the base the element is provided with lateral bands (22, 23) comprising striae (24, 25) leaving a slightly hollow smooth band (26, 27) for receiving a reflecting display sticker.

Figure 3:
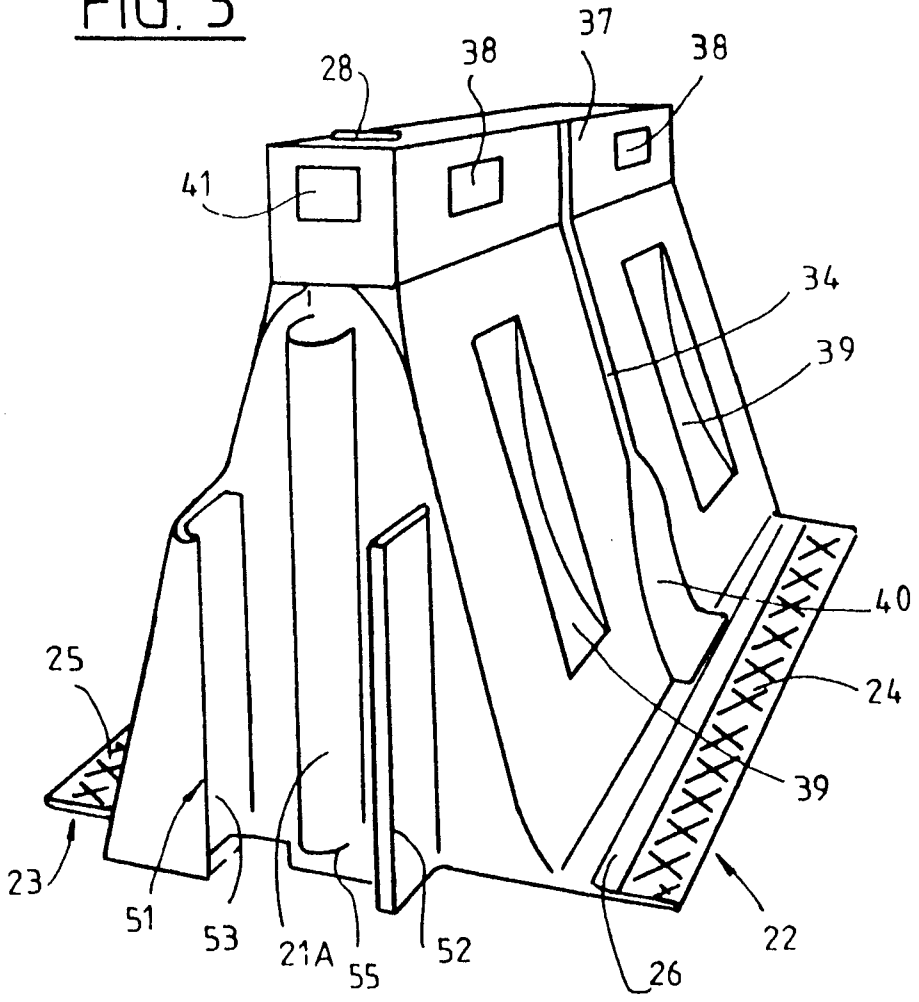
FIG. 3 is a perspective view of the separator element of FIG. 2.
Figure 2:
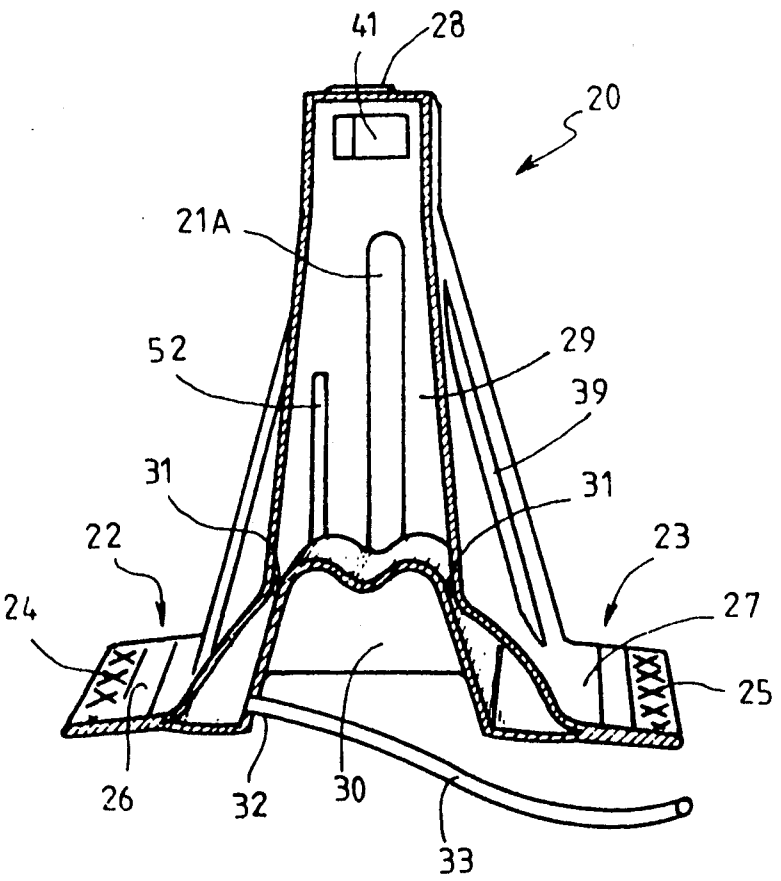
FIG. 2 is a cross-sectional view of an embodiment of a track separator element viewed from the rear according to the orientation of FIG. 3.

According to FIGS. 2, 3 and 4 the element (20) comprises at its upper part an opening with a plug (28) for filling. The interior chamber (29) thereof extends into the the lateral bands (22, 23) which are double-walled, so as to connect the different zones to the base of the interior chamber (29), in particular those produced as a result of the cavity (30) at the base of the element (20), and serving to increase the rigidity thereof. This cavity allows, in addition, water to trickle through and provides access to the emptying means as will be explained herein below. The inner reinforcement of the element is completed by connections (31) so that the element is not deformed under the effect of hydrostatic pressure.

According to FIG. 2, at the base, the element comprises a nozzle (32) to which an emptying tube (33) is attached. When this tube (33) rests on the ground as shown, it enables all the parts of the chamber (29) to be emptied through the tube (33). As shown in FIG. 2, the nozzle (32) which connects the tube (33) to the interior of the element (20) is connected to the interior portion of the lateral band (22). As previously explained, the interior chamber (29) is in fluid communication with the lateral band (22). Therefore, a drainage path for fluid within the interior chamber (29) is provided through the lateral band (22), the nozzle (32) and out the tube (33). In this manner, all parts of the chamber (29) can be emptied through the tube (33).

On the other hand, in order to conserve the ballasting liquid in the element (20) it is sufficient to raise the tube (33) and to hold it in this position. For this purpose the side of the element comprises laterally a fixing device (FIG. 3) in the form of housing (34) which receives the corresponding part of the flexible tube (33) by clipping; the tube (33) therefore remains held in this housing (34).

FIGS. 2 and 3 also show the substantially symmetrical overall shape of the element (20), having a triangular section, terminating in the upper part in a rectangular box (37) the lateral faces of which have locations (38) for the self-reflecting stickers. The sides of the elements are provided with stiffening deformations (39) (FIGS. 2, 3) and (39, 39') (FIG. 4). As was already mentioned, the cavity (30) is open on the two sides of the element (20) in order to form a passage (40) for water. This passage (40) is not symmetrical with respect to the longitudinal median plane and this cavity is enlarged on the nozzle side (32) in order to facilitate the access to the tube (33). Finally, at each end, the element (20) consists of a cavity forming a handle (41) and the assembly devices (21A, 21B).

In FIG. 2, the device (21A) appears recessed to the inside in FIG. 2 and raised in FIG. 3, the assembly of two male/female devices (21A, 21B) appearing in FIG. 4.

The male device (21A) is a circular cylinder with a vertical axis XX which engages in the female device (21B) which is in concave cylindrical form, having the same axis but a complementary section. These sections are selected in order to facilitate the engagement and to enable alignment errors to be absorbed or more frequently to follow curved lines.

The device (21A) is bordered on one side by a prismatic extension (51) of the body of the element (20) and on the other side by an stop plate (52).

The other end of the element (20) comprises a female device (21B) bordered on each side by an extension and an stop plate in order to cooperate respectively with the plate andd the end extension of an element to which the present element is attached.

Thus there is support between the extension and the plate of two elements (20) (FIG. 4) at each end of the assembled element.

In order that the devices (51, 52) cooperate and strengthen each other reciprocally, the extension (53) has an recessed surface (53) in which the plate (52) can be housed. Each side of the device (21A) is arranged in this way.

This cooperation closes the gap between the body of two elements and renders the separator smooth at the assembly points.

Figure 5:
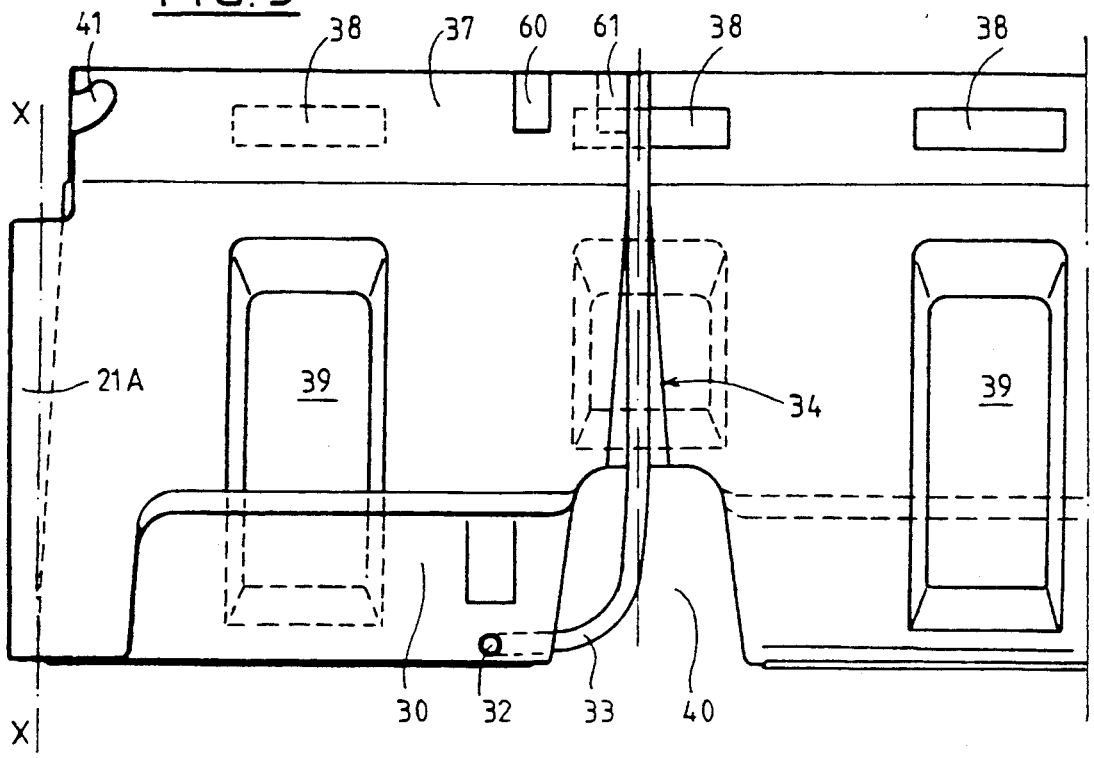
FIG. 5 is a partial side view with a median half section of the separator element according to the invention.
Figure 6:
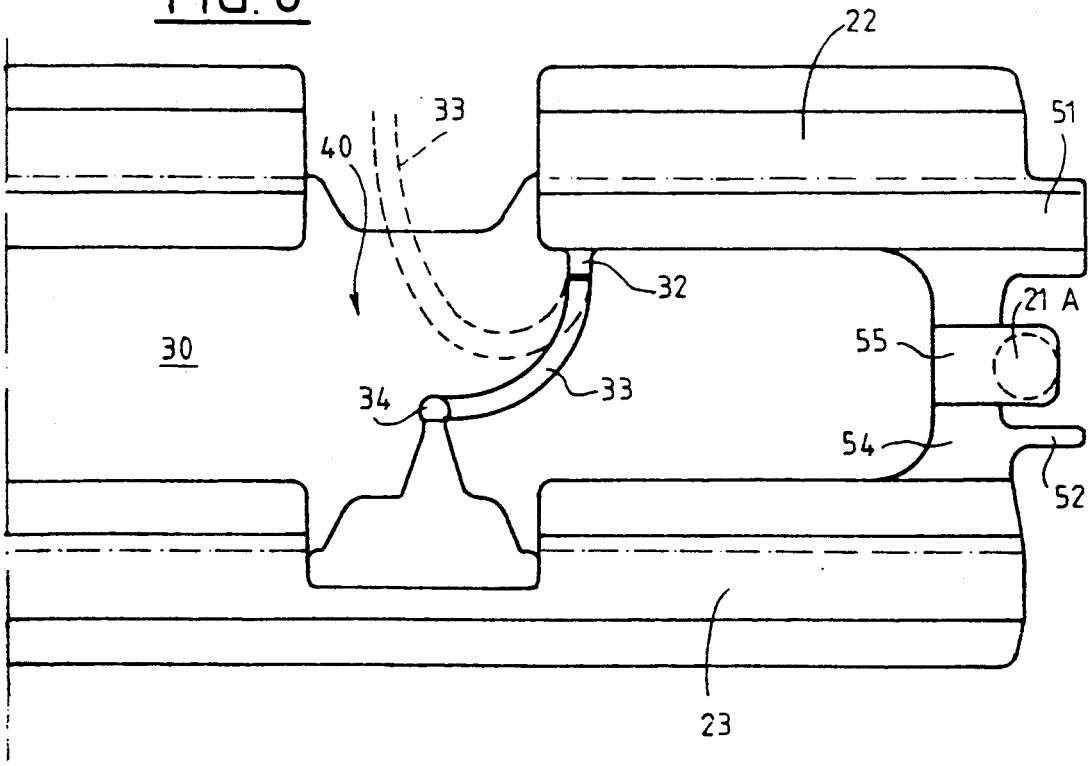
FIG. 6 is a schematic view from below of a part of the element of FIG. 4, showing the evacuation tube and the cavity.

The view from below in FIG. 5 shows the shape of the lateral bands (22, 23), the connection between the passage (40) and the cavity (30) as well as the nozzle (32), the tube (33) and the housing (34) thereof. According to this FIG. 6, the cavity (30) ends at each end in a transverse junction (54) to which the base (55) of the device (21A) is connected.

Finally, on the top of the element (FIG. 4) there are housings (60, 61, 62) of receiving the supports or fixing means for the signalling or display means. The track separator elements, such as those described above are preferably made from plastics materials, in particular by means of the rotational moulding process since large-sized pieces are involved.

It should be pointed out that the shape of the element can undergo numerous and various modifications making sure however in order that the internal partitioning, in particular at the cavity (30), is such that on the one hand fillable chambers are situated at a low level in order to lower the centre of gravity and to increase the stability of the element above when it is windy, and on the other hand to connect different chambers for the filling and emptying thereof.

I claim:

1. A portable traffic barrier which can be positioned in a use position on the ground at a desired location and then filled with a ballasting liquid, said traffic barrier comprising:

a hollow body having a rectangular cross-section, a top, a bottom, a first end, a second end and a part of longitudinal sides;

a support band connected to each of said pair of sides near said body bottom, said support band extending at an angle from said body so that said support band positions said body away from said ground when said barrier is in said use position, a first portion of each support band having a hollow interior in fluid communication with said body, a second portion of said band being attached to said first portion and extending parallel to said ground when said barrier is in said use position, said second band portion having deformations that generate a noise when a tire travels thereof;

an evacuation nozzle connected to one of said support bands for draining said ballasting liquid from said support band and said body;

a flexible tube having a first end connected to said evacuation nozzle and a second end;

means for releasably holding said tube second end in a raised position to prevent said ballasting liquid from draining through said tube;

male connection means connected to said first body end and female connection means connected to said second body end, said male connection means on a first barrier mating with said female connection means on a second barrier to movably attach said first and second barriers together; and a passage extending through said body from a first side to a second side, said passage further extending through said first portion of each support band, said passage providing a path for any water flowing on the ground at the desired location.

2. A portable traffic barrier as claimed in claim 1, wherein the male connection means comprises a cylindrical projection and a pair of support plates, said projection and pair of support plates extending vertically along a height of the barrier; and said female connection means comprises an extension plate having a cylindrical recess, said extension plate extending vertically along the height of the barrier, said extension plate fitting between the support plates with said projection fitting within the recess when said first and second barriers are attached together.

3. A portable traffic barrier as claimed in claim 2, wherein the extension plate includes a notch and at least one support plate includes a hooked portion, said hooked portion fitting within the notch when said first and second barriers are attached together.

4. A portable traffic barrier as claimed in claim 1, wherein the means for releasably holding comprises a housing formed in a side of said body and clamping means for releasably clamping the tube in a fixed position, said clamping means being located within the housing.

5. A portable traffic barrier as claimed in claim 1 including a hollow stiffening cavity, said stiffening cavity having a pair of sides and a top, said top being formed by the bottom of said body, said pair of sides being formed by the first portions of said pair of support bands;

said barrier further including stiffening recesses formed within the longitudinal sides of said body, said stiffening recesses extending vertically along said body.

6. A portable traffic barrier as claimed in claim 1, wherein said body includes a recess adapted to receive a hand such that said recess forms a handle by which the barrier can be carried, said body further including cavities adapted to receive luminescent of reflecting stickers.

7. A portable traffic barrier as claimed in claim 1 or 6, wherein said body includes housings adapted to receive signalling and display means.

8. A porable traffic barrier as claimed in any one of claims 1 to 6 wherein the barrier is formed of a plastic material.

9. A portable traffic barrier as claimed in claim 1, wherein the second portions of said support bands extend uninterrupted along each side of the barrier.

* * * * *

UNITED STATES PATENT AND TRADEMARK OFFICE

CERTIFICATE OF CORRECTION

PATENT NO. : 5,104,254

DATED : April 14, 1992

INVENTOR(S) : Robert Emilien Durand

It is certified that error appears in the above-identified patent and that said Letters Patent is hereby corrected as shown below:

Column 5, line 54 change "part" to -- pair --.

Column 5, line 68 change "thereof to --thereover --.

Column 6, line 57 change "of" to -- or --.

Signed and Sealed this

Twentieth Day of July, 1993

*Attest:*

Michael K. Kirk

MICHAEL K. KIRK

*Attesting Officer*

*Acting Commissioner of Patents and Trademarks*